US007681746B2

(12) United States Patent
Schmidt

(10) Patent No.: US 7,681,746 B2
(45) Date of Patent: Mar. 23, 2010

(54) MULTIPLE LEVEL PRODUCT DIVIDER

(75) Inventor: David G Schmidt, Grafton, WI (US)

(73) Assignee: Slingshot Marketing, Inc., Saukville, WI (US)

( * ) Notice: Subject to any disclaimer, the term of this patent is extended or adjusted under 35 U.S.C. 154(b) by 921 days.

(21) Appl. No.: 11/279,277

(22) Filed: Apr. 11, 2006

(65) Prior Publication Data

US 2006/0226104 A1 Oct. 12, 2006

Related U.S. Application Data

(60) Provisional application No. 60/670,601, filed on Apr. 12, 2005.

(51) Int. Cl.
*A47F 5/00* (2006.01)

(52) U.S. Cl. ..... 211/184

(58) Field of Classification Search ..... 211/184; 24/297, 453, 457, 458; 108/60, 61; 312/348.3, 312/35, 140.4; 220/529, 532; 273/271, 241, 273/287

See application file for complete search history.

(56) References Cited

U.S. PATENT DOCUMENTS

| | | | | | |
|---|---|---|---|---|---|
| 992,047 | A | * | 5/1911 | Peak | 211/51 |
| 1,317,589 | A | * | 9/1919 | Noziska | 211/184 |
| 1,508,610 | A | * | 9/1924 | O'Connor | 211/184 |
| 1,608,401 | A | * | 11/1926 | Kress | 312/140.3 |
| 3,149,729 | A | * | 9/1964 | Smith | 211/184 |
| 3,484,226 | A | * | 12/1969 | Golightly | 65/291 |
| 4,081,100 | A | * | 3/1978 | Presby | 220/544 |
| 4,243,227 | A | * | 1/1981 | Strongin | 273/357 |
| 4,381,112 | A | * | 4/1983 | Dupuy | 273/239 |
| 4,675,970 | A | * | 6/1987 | Galen | 29/413 |
| 4,744,612 | A | * | 5/1988 | Winter et al. | 312/140 |
| 4,768,661 | A | * | 9/1988 | Pfeifer | 211/184 |
| 4,809,856 | A | * | 3/1989 | Muth | 211/184 |
| 5,097,962 | A | * | 3/1992 | Eklof et al. | 211/59.2 |
| 5,209,360 | A | * | 5/1993 | Valiulis | 211/184 |
| 5,458,248 | A | * | 10/1995 | Alain | 211/175 |
| 5,489,031 | A | * | 2/1996 | Carroll | 211/134 |
| 5,638,963 | A | * | 6/1997 | Finnelly et al. | 211/59.3 |
| 5,884,782 | A | * | 3/1999 | Dembicks | 211/70.6 |
| 6,023,024 | A | * | 2/2000 | Stjerneby | 174/95 |

(Continued)

*Primary Examiner*—Jennifer E. Novosad
(74) *Attorney, Agent, or Firm*—Andrus, Sceales, Starke & Sawall, LLP

(57) ABSTRACT

A system for dividing a series of products within a display case, such as a freezer. The system includes a base positionable within the display case between products that are to be separated. The base is preferably formed from molded plastic and includes a series of horizontally extending support legs. The base includes a pair of parallel support arms that extend perpendicular to the support legs and are spaced from each other to define a receiving gap. The receiving gap is sized to receive a divider that can be positioned within the receiving gap. The base includes a series of support tabs each extending from the bottom wall of the base into the receiving gap to reduce the effective depth of the receiving gap. Each of the support tabs can be selectively removed from the base to increase the depth of the receiving gap. The depth of the receiving gap controls the amount of the divider extending past the top edge of the base. One of the support arms includes a locking member to securely hold the divider within the base.

13 Claims, 3 Drawing Sheets

U.S. PATENT DOCUMENTS 6,047,647 A * 4/2000 Laraia, Jr. ..... 108/61
6,227,385 B1 * 5/2001 Nickerson ..... 211/59.3
6,299,004 B1 * 10/2001 Thalenfeld et al. ..... 211/184
6,527,129 B2 * 3/2003 Osawa ..... 211/184
6,991,307 B2 * 1/2006 Hoenig ..... 312/348.3
7,063,217 B2 * 6/2006 Burke ..... 211/59.3
7,436,755 B2 * 10/2008 Takamori et al. ..... 369/275.1
7,461,436 B2 * 12/2008 Asano ..... 24/297
2007/0158281 A1 * 7/2007 Hardy ..... 211/59.3

* cited by examiner

MULTIPLE LEVEL PRODUCT DIVIDER

CROSS REFERENCE TO RELATED APPLICATION(S)

The present application is based on and claims priority to U.S. Provisional Patent Application No. 60/670,601, filed Apr. 12, 2005.

BACKGROUND OF THE INVENTION

The present invention relates to a plastic/laminated device that separated/divides a meat case (fresh or frozen) into multiple sections to keep brands or product separate from each other. Although the present invention is described as being particularly desirable in use in dividing products within a meat case, it should be understood that the invention could be equally applicable for other types of product separation.

Presently, divider bases exist in the field that are formed from plastic extrusions that have the shape of an inverted "T". The divider base is typically inserted into a freezer case and functions as a sign holder. The base can receive an upstanding divider to provide product information and further separate the products. In the prior systems, the divider is received within the base by a friction fit. In such a system, the divider can be easily separated from the base since the friction fit may not be sufficient due to molding tolerances and product wear.

In the presently available divider systems, the divider typically includes a display tab that is formed at the top edge of the divider. When the divider is received within the base, the display tab extends above the level of the products such that a consumer can identify products based upon printing or images placed upon the display tab. Since it is desirable to have the display tab positioned above the level of product, the size of the upstanding divider must be selected based upon the type of product and freezer configuration. If the depth of the freezer or height of the product is sufficiently large, the conventional divider is replaced with an extended divider. The use of multiple dividers each having a specific height requires an inventory of different divider types.

Therefore, a need currently exists for a divider product that allows the height of the divider to be modified depending upon the type of freezer and the height of product being used with the divider. Further, a need exists for a divider system that allows the divider to be securely retained within the base to prevent separation of the base and divider.

SUMMARY OF THE INVENTION

The present invention is a system for dividing a series of products contained within a display case. The system includes an extending information divider that provides information relating to the type of product being separated within the display case. The system provides for an adjustable divider such that the system can be used with various types of display cases and with various depths of products.

The system includes a molded plastic base that has a pair of generally planar support legs that extend horizontally and are positioned on the generally flat bottom of the display case. The support legs extend horizontally and are typically positioned beneath the products being separated.

The base further includes a pair of support arms that extend perpendicular to the support legs and are spaced from each other to define a receiving gap. Each of the support arms is preferably integrally molded with the pair of support legs to define a unitary base. The depth of the receiving gap is defined by a bottom wall of the base that is generally planar with the top surface of each of the support legs.

The base further includes at least a pair of support tabs that each extend from the bottom wall of the base into the receiving gap to decrease the effective depth of the receiving gap in the area of the support tab. Each support tab has a width slightly less than the width of the receiving gap such that the support tab is positioned entirely within the receiving gap. Each of the support tabs can be permanently separated from the base by fracturing the plastic tab at the point of intersection between the tab and the base bottom wall.

The system further includes a divider that is sized to be received within the receiving gap between the pair of spaced support arms. Preferably, the divider has a height greater than the maximum depth of the receiving gap such that the divider extends above the top edge of the support arms. The divider includes a display tab for displaying information about the products being separated.

When the support tabs remain attached to the bottom wall of the base, the divider contacts a top surface of the support tabs such that a top portion of the divider, including the display tab, extends past the top edge of the support arms. Alternatively, each of the support tabs can be separated from the base such that the divider extends fully into the receiving gap and is supported along the bottom wall of the base. Since the height of the divider is greater than the length of the support arms of the base, a portion of the divider and the display tab extends past the base even when the support tabs are removed. As can be understood, the support tabs can be selectively removed from the base to vary the depth of the receiving gap.

At least one of the support arms of the base includes a locking tab that extends from the support arm into the receiving gap. Each of the dividers also includes a first receiving notch and a second receiving notch, where the first and second receiving notches are spaced from each other along the height of the divider. When the divider is received within the receiving gap between the support arms, the locking tab engages the first receiving notch. When the support tabs are removed, the locking tabs of the support arm are received within the second set of receiving notches. Thus, the interaction between the locking tab formed on the support arm and the receiving notches formed in the divider allow the divider to be securely held in place regardless of the depth of the receiving gap.

The system of the present invention allows the depth of the receiving gap to be adjusted such that a single base can be used to vary the height of the divider above the base. When the divider is received within the base, the locking tab formed on one of the support arms restricts the separation of the divider from the base.

BRIEF DESCRIPTION OF THE DRAWINGS

The drawings illustrate the best mode presently contemplated of carrying out the invention. In the drawings.

DETAILED DESCRIPTION OF THE INVENTION

Figure 1:
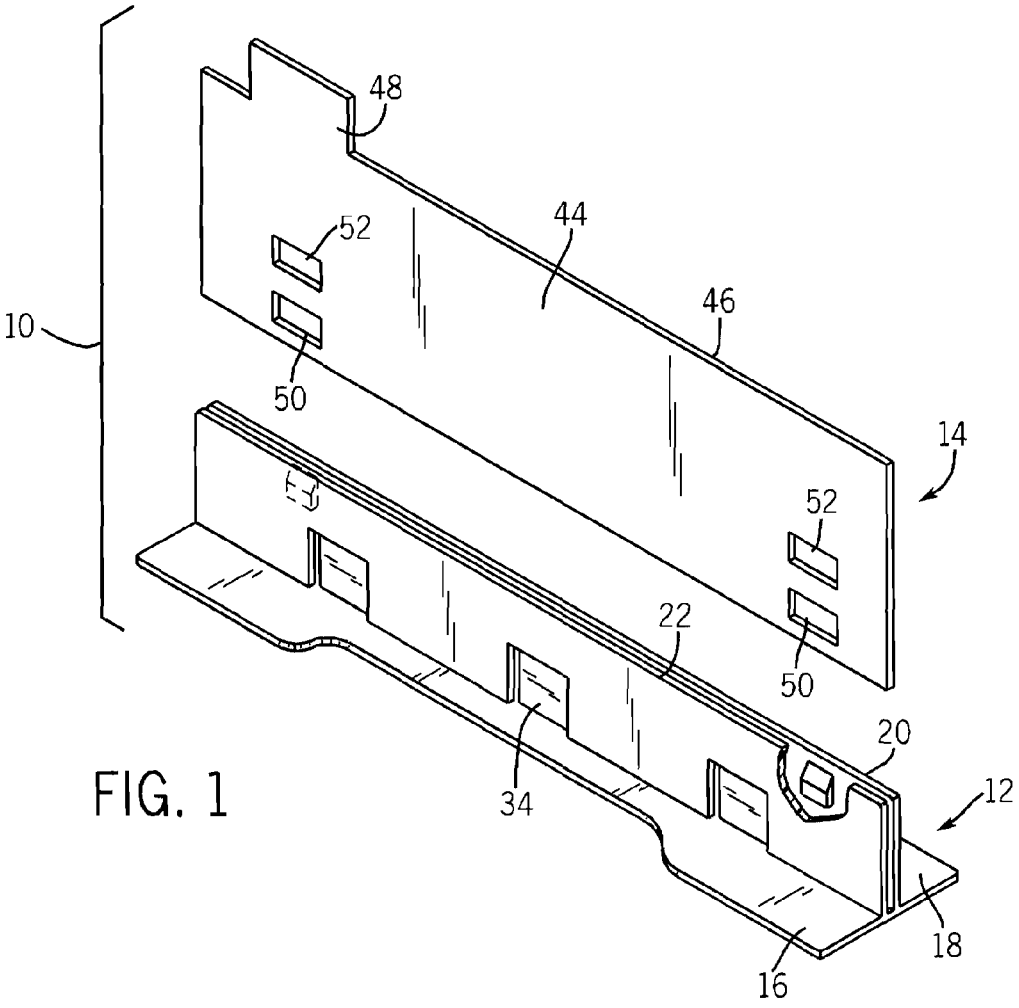
FIG. 1 is an exploded front perspective view of the base and product divider shown in their separated condition.

Referring first to FIG. 1, thereshown is a system that can be utilized to separate the products into different sections or areas in the display of meat or other products in a display case. Although the present invention will be described in the preferred embodiment as separating products within a frozen freezer case, it should be understood that the invention can be utilized in various other applications while operating within the scope of the present invention.

Figure 3:
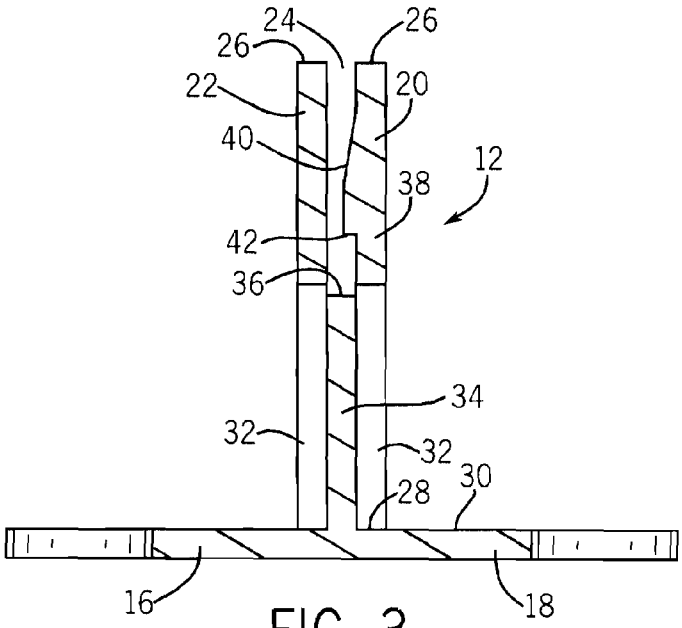
FIG. 3 is a section view showing the position of the support tab between the pair of extended support arms.

As illustrated in FIG. 1, the system includes a base 12 and a product divider 14 that can be separated from each other. The base 12 includes a pair of laterally extending support legs 16, 18 that are coplanar with each other. The support legs 16, 18 are typically received on the bottom wall of a display case and provide support for the entire base 12. The base 12 further includes a pair of extending support arms 20, 22 that each extend perpendicular to the support legs 16, 18. As best illustrated in FIG. 3, the support arms 20, 22 are spaced from each other to define a receiving gap 24. The receiving gap 24 extends from the top edge of each support arm 20, 22 to a bottom wall 28. As illustrated in FIG. 3, the bottom wall 28 is generally coplanar with the top surface 30 of each of the support legs 16, 18. In the preferred embodiment of the invention, the bottom wall 28, the pair of support legs 16, 18 and the pair of support arms 20, 22 are co-molded with each other and are formed of a plastic material.

Referring back to FIG. 2, each of the support arms 20, 22 includes a plurality of removed access openings 32. As illustrated in FIG. 3, the access opening 32 formed in the support arm 20 is aligned with a corresponding access opening 32 formed in the spaced support arm 22. Referring back to FIG. 2, each of the access openings 32 are aligned with a support tab 34 formed as part of the base 12. As illustrated in FIG. 3, each of the support tabs 34 extends upward from the bottom wall 28 into the receiving gap 24 and includes a top edge surface 36. In the preferred embodiment of the invention, each of the support tabs 34 is integrally formed with the base from the same plastic material used to form the remaining portions of the base. Each of the support tabs 34 is aligned between the pair of access openings 32 formed in the support arms 20, 22 such that each of the support tabs 34 can be removed from the base 12 by pushing the respective support tab from either side of the base to fracture the connection between the support tab 34 and the bottom wall 28. Once the support tabs 34 have been removed from the base 12, the support tabs 34 cannot be replaced with respect to the base 12.

Referring back to FIG. 3, when the support tabs 34 remain positioned between the support arms 20, 22, the effective depth of the receiving gap 24 is defined by the top surface 36 of the support tabs 34. When each of the support tabs 34 are removed from the base by fracturing the support tab from the bottom wall 28, the depth of the receiving gap is increased and is defined by the bottom wall 28. Thus, by removing the series of support tabs 34, the depth of the receiving gap 24 can be selectively modified.

Figure 2:
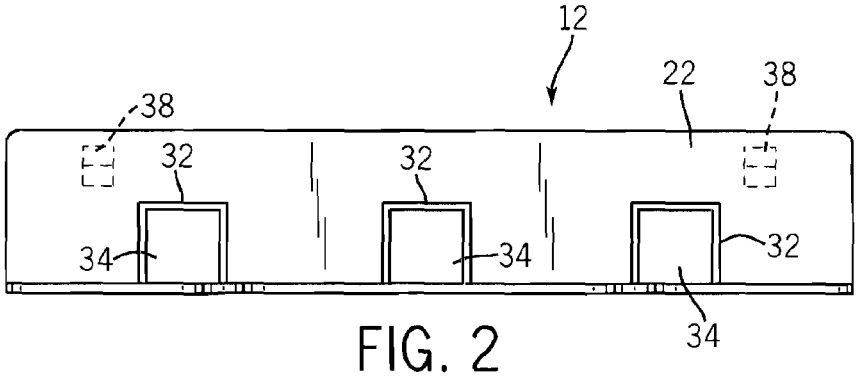
FIG. 2 is a front view of the base illustrating the spaced support tabs.

Referring now to FIGS. 2 and 3, the support arm 20 of the base 12 includes a pair of spaced locking tabs 38. As best illustrated in FIG. 3, each locking tab 38 extends from the inside surface of the support arm 20 into the receiving gap 24. The locking tab 38 includes an angled ramp 40 that transitions to a shoulder portion 42. As illustrated in FIG. 3, the shoulder 42 is positioned slightly above the top edge surface 36 of the support tab 34.

Referring back to FIG. 2, the pair of locking tabs 38 are spaced along the length of the base and function to provide secure points of connection between the base and the product divider, as will be discussed in greater detail below.

As shown in FIG. 1, the product divider 14 generally includes a main body 44 having a height A. The top edge 46 of the body 44 includes an extending display tab 48 that can be used to display printed information relating to the type of product being separated within the display case. The product divider 14 includes a pair of first receiving notches 50 and a pair of second receiving notches 52. The first and second receiving notches 50, 52 are spaced from each other along the height of the main body 44 such that the center line of each of the first and second receiving notches are spaced from each other by a distance generally corresponding to the height of each of the support tabs 34.

Figure 4:
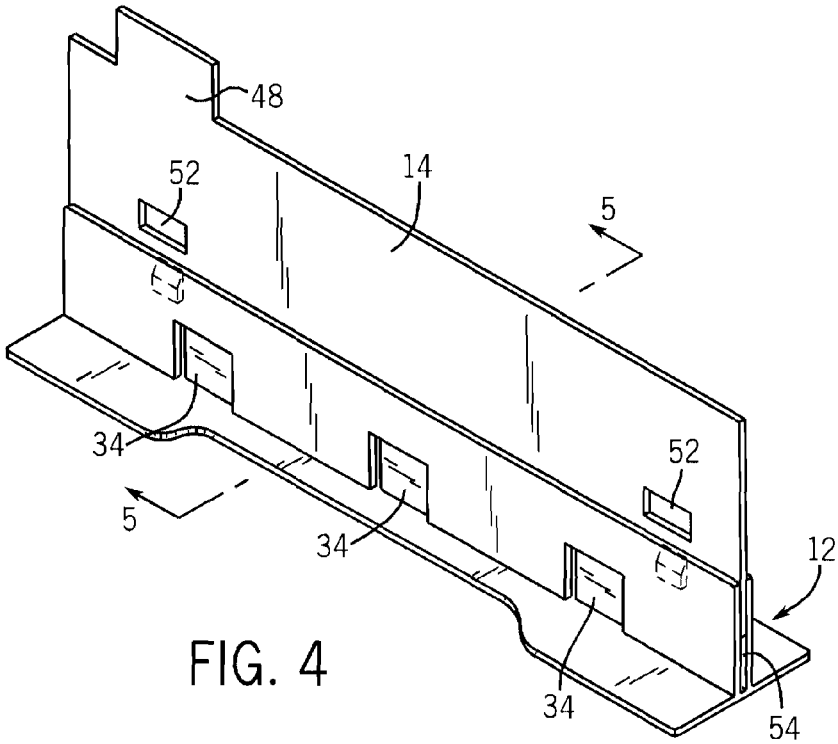
FIG. 4 is a front perspective view illustrating the product divider positioned within the base with the support tabs in place.
Figure 5:
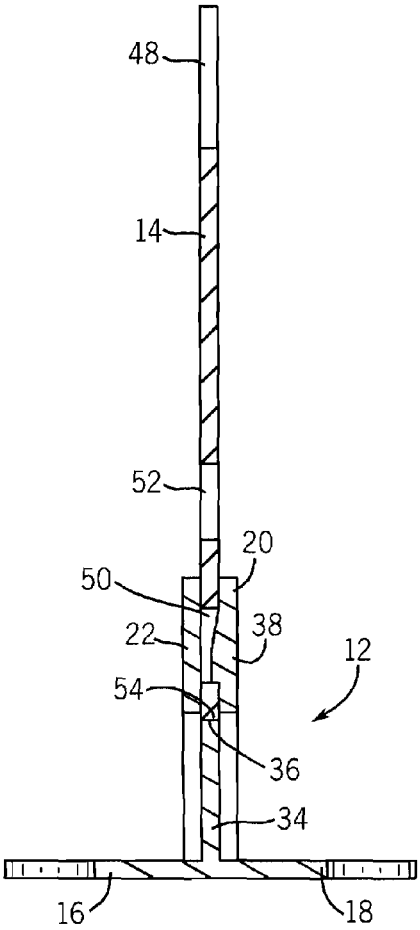
FIG. 5 is a section view of FIG. 4.

Referring now to FIGS. 4 and 5, when the series of the support tabs 34 remain attached to the base 12, the bottom edge surface 54 contacts and is supported by the top edge surface 36 of each of the support tabs 34. When the product divider 14 is in contact with the series of spaced support tabs 34, the locking tabs 38 are each received in one of the first receiving notches 50. The interaction between the locking tabs 38 and the first receiving notches 50 lock the divider 14 into position within the base 12 to restrict the separation between the base 12 and the product divider 14.

Figure 6:
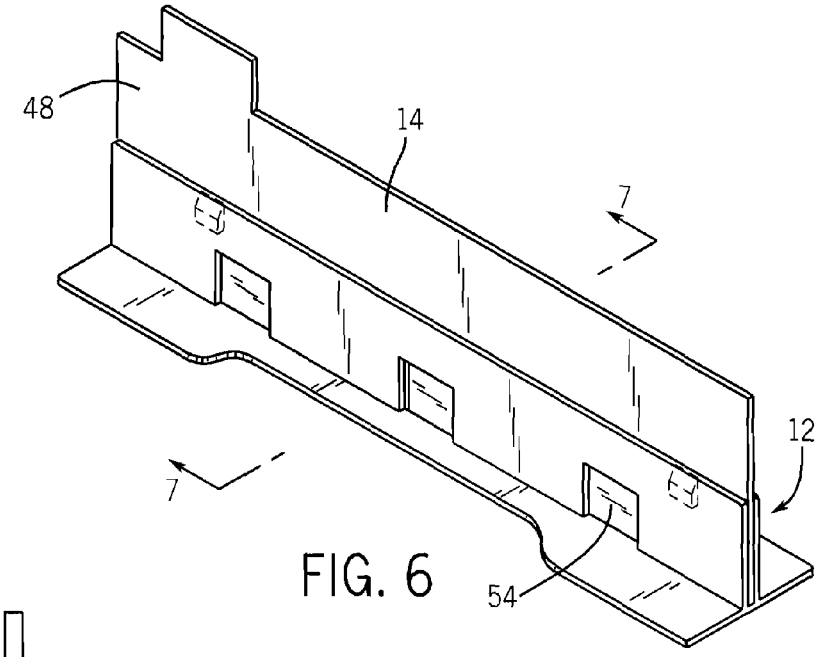
FIG. 6 is a front perspective view of the product divider fully inserted into the receiving gap between the pair of support arms.
Figure 7:
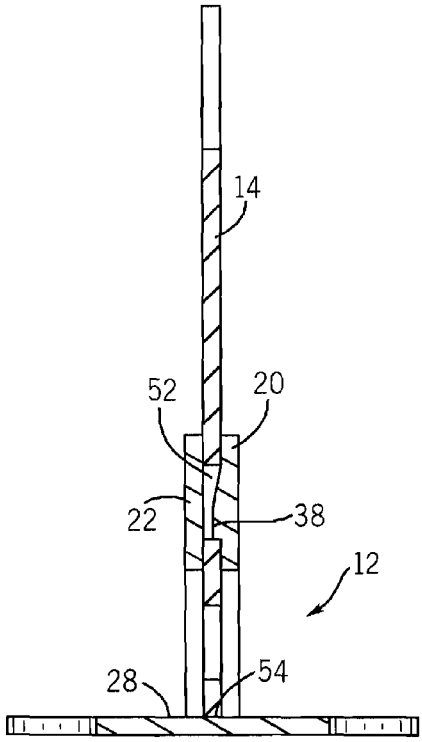
FIG. 7 is a section view taken along line 7-7 of FIG. 6.

Referring now to FIGS. 6 and 7, if the support tabs 34 are removed from the base 12, the product divider 14 can be fully inserted into the base 12 such that the bottom edge 54 of the divider 14 contacts the bottom wall 28 of the base. In this position, the locking tabs 38 formed on the support arm 20 are each received within one of the second receiving notches 52. The locking interaction between the locking tabs 38 and the second receiving notches 52 again restricts the separation between the product divider 14 and the base 12. The mechanical interaction holds the two pieces together and prevents separation better than a simple friction fit, as was the case in prior art systems.

As can be understood by a comparison between FIGS. 5 and 7, when the support tabs 34 remain attached to the base within the receiving gap between the pair of support arms 20, 22, the product divider 14 extends further above the pair of support legs 16, 18 which rest upon the refrigerator case. Thus, the single product divider 14 can be utilized to provide information to a potential consumer at different heights, depending upon the product requirement and display case configuration. Thus, selectively removing the support tabs 34 allows a retailer to adjust the height of the divider 14 from the bottom wall of the display case without requiring different dividers. Since the divider 14 includes spaced first and second receiving notches 50, 52, respectively, the single divider can be securely retained within the base by the locking tabs 38 at at least two different heights In the preferred embodiment of the invention shown in the drawings, the base member 12 has an overall length of approximately 14". Each of the support tabs 34 has a height of 1" such that the height of the divider 14 can be adjusted by the 1" height of the support tab 34. Although not shown in the drawings, it is contemplated by the inventor that a pair of base sections 12 could be positioned in an end-to-end configuration to define a base having a combined length of 28". In such a system, the divider 14 could also be provided having a length of 28" and having two additional sets of first and second receiving notches 50, 52 such that the single, 28"divider could be utilized to lock two base sections together. In a divider having a total length of 28", the divider will include the four sets of first and second receiving notches 50, 52 such that the single divider 14 would lock the pair of base members together to form a joined unit.

I claim:

1. A system for dividing a plurality of products in a display case and displaying product information, the system comprising:

a base having a pair of support legs and a pair of support arms extending from a bottom wall and spaced from each other to define a receiving gap, wherein at least one of the support arms includes a locking tab extending into the receiving gap;

at least one removable support tab extending into the receiving gap from the bottom wall and positioned between the pair of support arms, wherein the support tab is selectively removable to adjust the effective depth of the receiving gap; and a divider receivable within the receiving gap between the pair of support arms, the divider including a first receiving notch and a second receiving notch, wherein the divider is supported on the support tab and the locking tab is received in the first receiving notch in a first condition and wherein the divider contacts the bottom wall of the base and the locking tab is received in the second receiving notch in a second condition when the support tab is removed.

2. The system of claim 1 wherein the support tab is integrally formed with the base.

3. The system of claim 1 wherein each support tab includes a top surface positioned above the bottom wall of the base, wherein the divider contacts the top surface of the support tab in the first condition.

4. The system of claim 1 wherein the support arms include a pair of spaced locking tabs and the divider includes a pair of first receiving notches and a pair of second receiving notches.

5. The system of claim 1 wherein the divider includes a display tab extending from a top surface of the divider, wherein the display tab extends past the support arms when the divider is received between the support arms and the support tab is removed.

6. The system of claim 1 wherein the support tab is aligned with a removed access opening formed in each of the support arms.

7. A system for dividing a plurality of products in a display case and displaying product information, the system comprising:

a base having a pair of support legs, a pair of generally parallel support arms each extending perpendicular to the support legs and spaced from each other to define a receiving gap, and a bottom wall generally planar with the support legs, werein at least one of the support arms includes a locking tab extending into the receiving gap;

a plurality of removable support tabs positioned between the support arms and each extending from the bottom wall into the receiving gap; and a divider sized to be received within the receiving gap between the support arms and including a first receiving notch and a second receiving notch, wherein the divider is supported by the support tabs and the locking tab is received in the first receiving notch when the support tabs remain between the support arms and wherein the divider contacts the bottom wall of the base and the locking tab is received in the second receiving notch when the support tabs are removed.

8. The system of claim 7 wherein the support tabs are integrally formed with the base.

9. The system of claim 7 wherein the divider includes a display tab extending from a top surface of the divider, wherein the display tab extends past the support arms when the divider is received between the support arms and the support tabs are removed.

10. The system of claim 7 wherein the support arms include a pair of spaced locking tabs and the divider includes a pair of first receiving notches and a pair of second receiving notches.

11. The system of claim 7 wherein each of the support tabs is aligned with a removed access opening formed in each of the support arms such that the support tabs can be separated from the base.

12. A system for dividing a plurality of products in a display case and displaying product information, the system comprising:

a base having a pair of support legs, a pair of generally parallel support arms each extending perpendicular to the support legs and spaced from each other to define a receiving gap, and a bottom wall generally planar with the support legs, wherein at least one of the support arms includes a locking tab extending into the receiving gap;

a plurality of removable support tabs positioned between the support arms and each extending from the bottom wall into the receiving gap, wherein each of the support tabs is aligned with a removed access opening formed in each of the support arms; and a divider sized to be received within the receiving gap between the support arms, the divider including a pair of first receiving notches and a pair of second receiving notches spaced from the first receiving notches, wherein the divider is supported by the support tabs and the locking tab is received in one of the pair of first receiving notches in a first condition when the support tabs remain between the support arms and wherein the divider contacts the bottom wall of the base and the locking tab is received in one of the second receiving notches in a second condition when the support tabs are removed from between the support arms.

13. The system of claim 12 wherein the support tabs are integrally formed with the base.

* * * * *